US008454265B2

(12) United States Patent
Carroll

(10) Patent No.: US 8,454,265 B2
(45) Date of Patent: Jun. 4, 2013

(54) APPARATUS FOR TRANSFERRING LOADS BETWEEN CONCRETE SLABS

(75) Inventor: Michael E. Carroll, Loganville, GA (US)

(73) Assignee: EZ Form, Inc., Loganville, GA (US)

( * ) Notice: Subject to any disclaimer, the term of this patent is extended or adjusted under 35 U.S.C. 154(b) by 1863 days.

(21) Appl. No.: 11/109,781

(22) Filed: Apr. 20, 2005

(65) Prior Publication Data

US 2006/0177267 A1 Aug. 10, 2006

Related U.S. Application Data

(63) Continuation-in-part of application No. 11/077,557, filed on Mar. 11, 2005, now abandoned.

(51) Int. Cl.
*E01C 11/14* (2006.01)

(52) U.S. Cl.
USPC ..... 404/48; 404/59; 404/66

(58) Field of Classification Search
USPC ..... 404/47, 48, 51, 56, 57, 58, 59, 61, 404/64, 65, 66, 74, 87, 88, 89; 249/2, 3, 4, 249/5, 6, 7, 9, 96, 97
See application file for complete search history.

(56) References Cited

U.S. PATENT DOCUMENTS

| | | | | |
|---|---|---|---|---|
| 94,066 | A | | 8/1869 | Betteley |
| 220,693 | A | | 10/1879 | Anderson et al. |
| 40,047 | A | | 4/1889 | O'Conner |
| 920,808 | A | | 5/1909 | Alcott |
| 1,191,884 | A | | 7/1916 | Finch |
| 1,223,045 | A | * | 4/1917 | Ferguson ..... 404/56 |
| 1,604,991 | A | | 11/1926 | Gregg et al. |
| 1,659,326 | A | | 2/1928 | Meyercord |
| 1,632,395 | A | | 6/1929 | Fellows |
| 1,856,722 | A | | 5/1932 | Clifford |
| 2,132,547 | A | | 10/1938 | Sohn |
| 2,192,246 | A | | 3/1940 | Strube |
| 2,201,134 | A | | 5/1940 | Brickman et al. |
| 2,212,615 | A | | 8/1940 | Older |
| 2,212,680 | A | | 8/1940 | Brickman et al. |
| 2,215,653 | A | | 9/1940 | Robertson |
| 2,257,001 | A | | 9/1941 | Davis |
| 2,296,553 | A | | 9/1942 | Heritage et al. |
| 2,305,979 | A | | 12/1942 | Mitchell |
| 2,337,156 | A | | 12/1943 | Elmendorf |
| 2,405,428 | A | | 8/1946 | Jacobson |
| 2,452,462 | A | | 10/1948 | Hertzei |
| 2,509,180 | A | | 5/1950 | Yeoman |
| 2,575,247 | A | | 11/1951 | Carter |
| 2,772,468 | A | * | 12/1956 | Heltzel ..... 249/3 |
| 3,267,823 | A | | 4/1966 | Macrae |
| 3,329,072 | A | * | 7/1967 | Rice ..... 404/59 |
| 3,354,180 | A | * | 11/1967 | Ekiss et al. ..... 264/338 |
| 3,397,626 | A | | 8/1968 | Kornick et al. |
| 3,478,480 | A | | 11/1969 | Swenson |
| 3,859,769 | A | * | 1/1975 | Watkins ..... 52/591.1 |
| 4,021,989 | A | | 5/1977 | Hala |
| 4,110,053 | A | | 8/1978 | Buchholz |

(Continued)

*Primary Examiner* — Michael Safavi
(74) *Attorney, Agent, or Firm* — Michael J. Mehrman; Mehrman Law Office

(57) ABSTRACT

An embodiment configured according to principles of the invention includes a plate defining a hexagon having a base parallel with joint between concrete slabs. Another embodiment includes a hexagon-shaped plate having a first portion and a second portion, and a form having a slot configured to closely receive the second portion.

3 Claims, 11 Drawing Sheets

U.S. PATENT DOCUMENTS 4,449,844 A 5/1984 Larsen
4,453,360 A 6/1984 Barenberg
4,724,649 A 2/1988 Lowndes, III
5,005,331 A 4/1991 Shaw et al.
5,015,117 A 5/1991 Pawlicki
5,088,247 A 2/1992 Young
5,207,045 A 5/1993 Bodnar
5,216,862 A 6/1993 Shaw et al.
5,261,194 A 11/1993 Roberts
5,261,635 A * 11/1993 Flathau ..... 249/7
5,329,737 A 7/1994 Roberts
5,458,433 A 10/1995 Stastny
5,487,249 A 1/1996 Shaw et al.
5,560,151 A 10/1996 Roberts
5,619,834 A 4/1997 Chen
5,623,799 A 4/1997 Kowalski
5,657,602 A 8/1997 Hellander
5,658,483 A 8/1997 Boeshart
5,674,028 A * 10/1997 Norin ..... 404/74
5,713,174 A 2/1998 Kramer
5,730,544 A 3/1998 Dils et al.
5,732,518 A 3/1998 Roberts
5,797,231 A 8/1998 Kramer
5,870,869 A 2/1999 Schrader
5,934,821 A 8/1999 Shaw et al.
5,941,045 A 8/1999 Plehanoff et al.
5,955,203 A 9/1999 Briggs et al.
6,195,956 B1 3/2001 Reyneveld
6,354,760 B1 * 3/2002 Boxall et al. ..... 404/56
6,634,077 B2 * 10/2003 Layfield ..... 403/294
6,758,023 B1 7/2004 Sorkin
6,761,345 B1 * 7/2004 Reyneveld ..... 249/9
6,775,952 B2 8/2004 Boxall et al.
6,926,463 B2 * 8/2005 Shaw et al. ..... 404/58
7,131,624 B2 * 11/2006 Bogrett ..... 249/4
2003/0033778 A1 2/2003 Boxall et al.
2004/0187431 A1 9/2004 Boxall et al.
2006/0127179 A1 * 6/2006 Nadler ..... 404/47

* cited by examiner

APPARATUS FOR TRANSFERRING LOADS BETWEEN CONCRETE SLABS

REFERENCE TO EARLIER APPLICATION

This Application claims the benefit of U.S. Provisional Patent Application Ser. No. 60/650,954, filed Feb. 9, 2005, and is a continuation-in-part of U.S. Utility patent application Ser. No. 11/077,557, filed Mar. 11, 2005, by Stephen F. McDonald for Method of Forming Concrete and an Apparatus for Same.

BACKGROUND OF THE INVENTION

Conventional concrete pavement installation involves preparing then positioning forms around an area intended for pavement. The forms have vertical inner surfaces to receive and contain poured concrete. The forms have horizontal top surfaces, which typically are level with the surface of the poured concrete, or, once cured, pavement surface. The forms have back surfaces that rest against appropriately-spaced stakes for holding the forms in place. To provide clearance for finish troweling, concrete workers often field cut chamfers between the top and back surfaces of the forms.

Very large pavements require substantial form preparation and positioning. This is especially true if stock materials for forms are short and/or flexible. Short and flexible forms require more staking than longer, more rigid forms to ensure true, unwavy pavement edges. Short forms also require more setup time for chamferring. Regardless of whether the forms are long or short, field chamferring requires considerable time for large pavement areas.

Ideally, the forms used for receiving poured concrete should have a true height for providing a true slab thickness. Unfortunately, forms in the field typically have a height that is less than a true height for an appropriate slab thickness. These forms of inadequate height typically may be positioned so that the top surfaces are at an appropriate height relative to the desired pavement surface height, but present bottom surfaces that do not contact, thus admit gaps through which poured concrete leaks. This wastes concrete and requires additional work to remove the excess portions.

Concrete leakage from the forms, especially at the butt joints, leaves depressions in a finished slab surface causing poor aesthetics. The depressions also impair surface coverings, such as tile, because the uneven surface promotes uneven or incomplete covering layout and adhesion. Cured leaked concrete also impinges on adjacent slabs causing voids and/or increasing the chances of obtaining a locked construction, which leads to cracks and joint failures. Finally, removing the cured excess typically damages the slab from which the excess is chiseled. Thus, avoiding form leaks is highly desirable.

Unfortunately, none of the foregoing provides a method of forming concrete and an apparatus for same that includes stiff, infinitely long, pre-chamferred forms with predetermined true height.

In construction of concrete pavements for highways, airport runways, large warehouse buildings and the like, preventing random cracking of the concrete necessitates dividing the pavement into convenient slab sections. To this end, concrete workers pour a monolithic concrete slab that is allowed to set for a short period. Then, the workers cut transverse grooves, having a depth on the order of one-fourth of the slab thickness, across the slab, with spacing between cuts selected in accordance with the application and design. Spacings from 12 to 40 feet are common for highway pavements.

As the concrete of the slab cures, forces derived from the exothermal curing reactions cause generally vertical cracks to develop through the slab thickness at the reduced cross-sections below each groove. This controlled cracking effectively divides the slab into predetermined separate slab sections.

The vertical cracks or joints define adjacent and interlocking faces formed by the cement and aggregates in the concrete. The interlocking faces transfer vertical shear stresses among adjacent slab sections, a phenomenon commonly referred to as "aggregate interlock," as heavy objects, such as motor vehicles, pass over the joint.

Aggregate interlock causes wear among slab intersections with increasing use of the pavement. Additionally, cyclical and extreme temperature changes decrease slab volumes. Thus, over time, as traffic continuously passes over a joint, the intersections wear and become smooth, then fail altogether, resulting in relative vertical displacement of adjacent slab sections, hence a rough pavement surface. Joint failure also becomes increasingly susceptible to water intrusion, which may freeze and cause damage among adjacent slabs.

To discourage relative vertical displacement among adjacent slabs, prior art techniques provide for implanting dowels in concrete extending across the joint intersections. Some dowels are smooth steel rods with diameters on the order of one inch and lengths of two feet. Each rod is coated or otherwise treated so that it will not bond to concrete along its length or at least on one end thereof. Thus, as a slab expands and contracts during curing and subsequently with temperature changes, the dowel is free to move horizontally relative to, yet maintain vertical alignment of adjacent slabs, augmenting the aggregate interlock to transfer vertical shear stresses across the joints. See, for example, U.S. Pat. No. 3,397,626, issued Aug. 20, 1968, to J. B. Kornick et al. for Plastic Coated Dowel Bar for Concrete and U.S. Pat. No. 4,449,844, issued May 22, 1984, to T. J. Larsen for Dowel for Pavement Joints.

Among other problems, the foregoing techniques involve significant time and labor to produce and place the dowels.

Another technique to discourage relative vertical displacement among adjacent slabs involves embedding square-shaped load plates in adjacent slabs with opposed corners of the load plate aligned with the joint. To avoid shrink- or thermally-induced stress creation between the plate and a slab, concrete workers first embed a blockout sheath in one vertical joint face for receiving a load plate. To this end, the workers nail onto a form a mounting plate, from which a blockout sheath extends, then position the form to receive poured concrete. Once the concrete is cured and bonded to the blockout sheath, the workers remove the form board and leave the blockout sheath in place. Then the workers insert a load plate into the blockout sheath. Finally, the workers pour an adjacent slab, which bonds to the exposed portion of the load plate. See, for example, U.S. Pat. No. 6,354,760, issued Mar. 12, 2002, to Boxall et al., for System for Transferring Loads Between Cast-in-Place Slabs.

Drawbacks of the foregoing include the cost and labor associated with producing separate mounting and load plates, then assembling same following curing of a first concrete slab.

Referring to FIG. 13, a concrete floor 1100 typically is made up of a series of individual blocks or slabs 1102-1 through 1102-6 (collectively 1102). The same is true for sidewalks, driveways, roads and the like. Blocks 1102 provide several advantages, including relief of internal stress due to drying shrinkage and thermal movement. Adjacent blocks 1102 meet at joints 1104-1 through 1104-7 (collectively 1104). Joints 1104 typically are spaced so that each block

1102 has enough strength to overcome internal stresses that otherwise would cause random stress relief cracks. In practice, blocks 1102 should be allowed to move individually, but also should be able to transfer loads from one block to another block.

Transferring loads between blocks 1102 usually is accomplished with smooth steel rods, also referred to as dowels, embedded in two blocks 1102 defining joint 1104. For instance, FIG. 14 shows a side view of dowel 1200 between slabs 1102-4 and 1102-5. FIG. 15 shows a cross-sectional view along line XV-XV in FIG. 14 of several dowels 1200 spanning joints 1104 between slabs 1102. Typically, a dowel or bar 1200 is approximately 14 to 24 inches long, has either a circular or square cross-sectional shape, and a thickness of approximately 0.5-2 inches. Such circular or square dowels are capable of transferring loads between adjacent slabs 1102, but have several shortcomings.

U.S. Pat. Nos. 5,005,331, 5,216,862 and 5,487,249, issued to Shaw et al., which are incorporated herein by reference, disclose tubular dowels receiving sheaths for use with dowel bars having circular cross-sections.

Referring to FIG. 16, a shortcoming of circular or square dowels is that if dowels 1200 are misaligned, or not perpendicular to joint 1104, they can undesirably lock the joint together causing unwanted stresses that could lead to slab failure in the form of cracking. Such misaligned dowels can restrict movement in the directions 1400-1 and 1400-2.

Another shortcoming of square and round dowels is that they typically allow slabs to move only along the longitudinal axis of the dowel. As shown in FIG. 17, movement is allowed in direction 1500, parallel to dowels 1200, while movement in other directions 1502-1 and 1502-2, and directions into and out from the page is restrained. Such restraint of movement in directions other than parallel to the longitudinal axes of dowels 1200 could result in slab failure in the form of cracking.

U.S. Pat. No. 4,733,513 ('513 patent) issued to Shrader et al., which is incorporated herein by reference, discloses a dowel bar having a rectangular cross-section and resilient facings attached to the sides of the bar. As disclosed in column 5, at lines 47-49 of the '513 patent, such bars, when used for typical concrete paving slabs, would have a cross-section on the order of ½ to 2-inch square and a length on the order of 2 to 4 feet.

Referring to FIGS. 18 and 19, yet another shortcoming of prior art dowel bars is that, under a load, only the first 3-4 inches of each dowel bar transfers the load. This creates very high loadings per square inch at the edge of slab 1102-2, which can result in failure 1600 of the concrete below dowel 1200, as shown in FIGS. 18 and 19. Such a failure also could occur above dowel 1200.

Unfortunately, none of the foregoing provide a method of forming concrete and an apparatus for same that includes partially coated load plates carried in slotted forms.

What are needed, and not taught or suggested in the art, are a method of forming concrete and an apparatus for same that provide partially coated load plates carried in pre-slotted, stiff, infinitely long, pre-chamferred forms with predetermined true height that: (1) increase relative movement between slabs in a true direction parallel to the longitudinal axis of the joint; (2) reduce loadings per square inch close to the joint; (3) maximize material at the joint for transferring loads between adjacent cast-in-place slabs efficiently; (4) minimize raw materials needed in a load plate; and (5) promote exact load plate positioning to foster better perpendicular and parallel alignment with the joint and upper concrete surface.

SUMMARY OF THE INVENTION

The invention overcomes the disadvantages noted above by providing a method of forming concrete and an apparatus for same that provide partially coated load plates carried in pre-slotted, stiff, infinitely long, pre-chamferred forms with predetermined true height. An embodiment configured according to principles of the invention includes a plate defining a hexagon having a base parallel with joint between concrete slabs.

Another embodiment configured according to principles of the invention includes a hexagon-shaped plate having a first portion and a second portion, and a form having a slot configured to closely receive the second portion.

The invention provides improved elements and arrangements thereof, for the purposes described, which are inexpensive, dependable and effective in accomplishing intended purposes of the invention.

Other features and advantages of the invention will become apparent from the following description of the preferred embodiments, which refers to the accompanying drawings.

BRIEF DESCRIPTION OF THE DRAWINGS

The invention is described in detail below with reference to the following figures, throughout which similar reference characters denote corresponding features consistently, wherein.

DETAILED DESCRIPTION OF THE PREFERRED EMBODIMENTS

The invention is a method of forming concrete and an apparatus for same that provide partially coated load plates carried in pre-slotted, stiff, infinitely long, pre-chamferred forms with predetermined true height.

Figure 1:
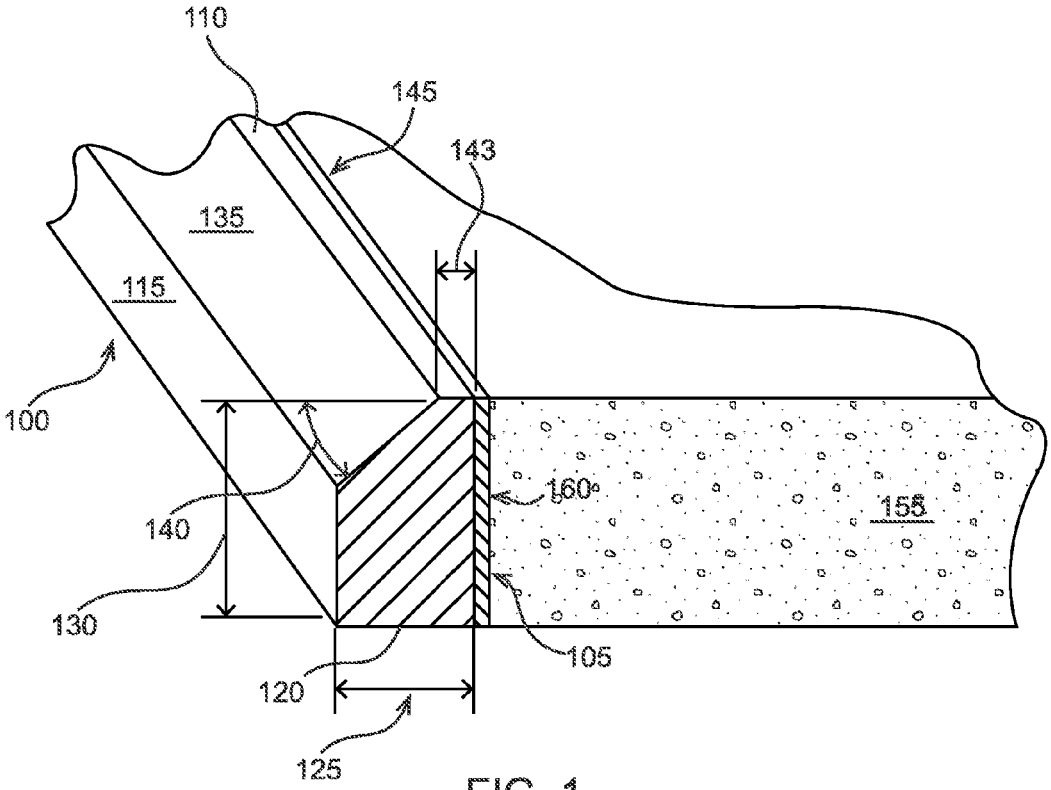
FIG. 1 is an environmental perspective view of an embodiment of an apparatus for forming concrete configured according to principles of the invention shown adjacent to concrete.

Referring to FIG. 1, an embodiment of an apparatus for forming concrete configured according to principles of the invention includes a form 100. Form 100 has a side surface 105, a top surface 110, a back surface 115 and a bottom surface 120. Side surface 105 and back surface 115 define a width 125 ranging from 0.875 to 2.500 inches. Top surface 110 and bottom surface 120 define a height 130 ranging from 3 to 18 inches or more, depending on the thickness required for pavement.

Form 100 has a chamfer 135 between top surface 110 and back surface 115. Chamfer 135 defines an angle 140 relative to top surface 110 ranging from 100 to 89°, preferably 22.50 to 45°. Side surface 105 and chamfer 135 define a top surface width 143 ranging from 0.125 to 0.875 inch. Chamfer 135 provides clearance for trowels and other finishing tools and allows for faster concrete finishing.

Width 125, height 130, angle 140 and top surface width 143 vary as needed to provide a desired overall stiffness of form 100. Form stiffness dictates the amount of staking required to maintain form 100 in place against the great weight of poured concrete 155. Stiffer forms 100 require less staking, thus less labor to place forms 100 where needed.

More importantly, form stiffness impacts the trueness of an edge 145 defined by side surface 105 and top surface 110, which forms a corresponding edge in concrete 155 when cured. Good trueness is important to the overall appearance of a pavement defined by multiple slabs having adjacent edges. For example, if an edge of one slab has poor trueness and is adjacent to another slab edge that has poor trueness, the gap defined between the un-true edges will exhibit unsightly non-uniformity, or portions of the gap that may be too narrow followed by portions that may be too wide. This gap non-uniformity contributes to an overall non-professional image of the area and associated business.

Preferably, form 100 is constructed of oriented strand board (OSB). OSB stock may be manufactured to assume virtually any dimension, which may be machined, as described below, to define forms 100 of virtually any length. As the invention is intended for constructing large-scale pavements, forms 100 with very large lengths are desirable because fewer abutting forms 100 are needed to define a continuous side surface 105 and edge 145, hence slab side. This reduces the labor needed to limit and/or treat discontinuities that may occur in the slab side. OSB stock also is preferred because it may be machined to define a desired height 130. This eliminates the occurrence of concrete leaks between the bottom surface of prior art forms of inadequate height and the supporting surface underlying the concrete.

Form 100 also may be constructed of dimensional lumber, particle board, metal, plastic, cardboard, fiber board, polyurethane foam, Styrofoam®, or other rigid synthetic or other suitable materials commensurate with the purposes described herein.

A release overlay 160 is disposed on side surface 105. Release overlay 160 is constructed of phenolic paper, kraft paper, acrylic, latex, melamine, Formica®, foil, oil, high density overlay, metal or other suitable material that provides a smooth, closed-celled surface, substantially free of pores for retaining poured concrete without adhering to or marring the finished surface thereof when cured and separated from form 100.

Figure 2:
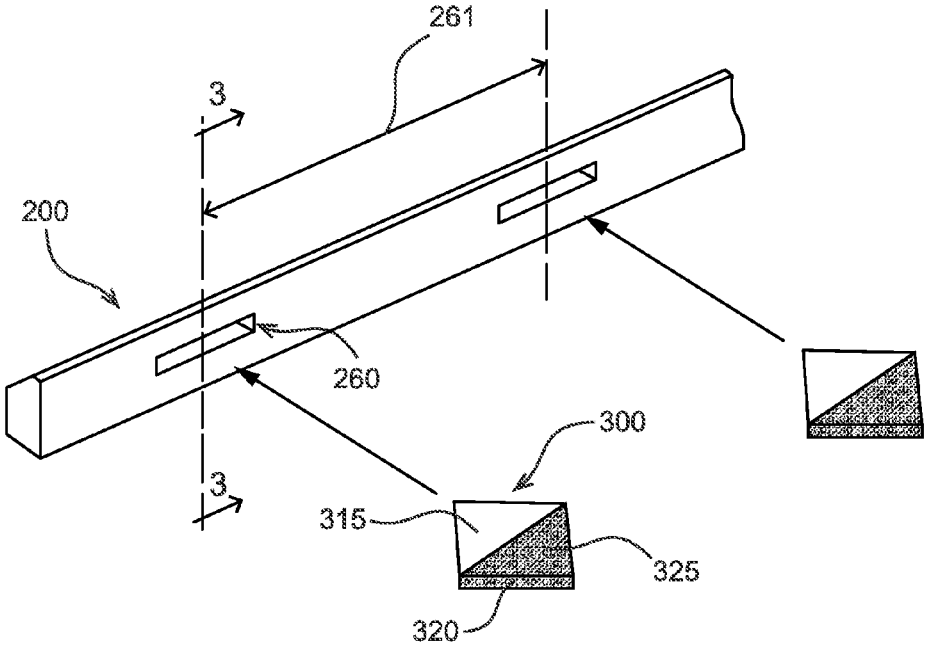
FIG. 2 is a top front right side elevational view of another embodiment of an apparatus for forming concrete configured according to principles of the invention.

Referring to FIG. 2, another embodiment of an apparatus for forming concrete configured according to principles of the invention includes a form 200 and one or more plates 300 received in form 200. Form 200 is constructed similarly to form 100 and has slots 260 for receiving plates 300. Slots 260 have a spacing 261 of about two feet, or other dimension suitable for purposes described herein.

Figure 3:
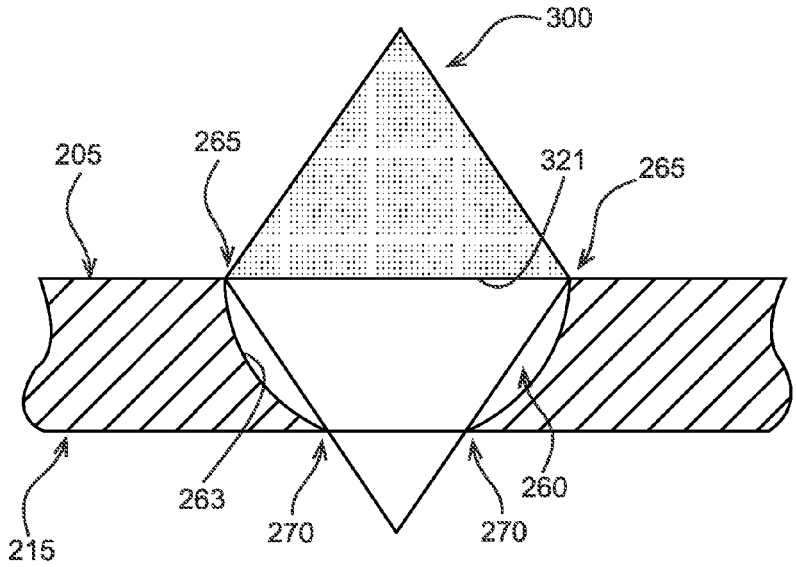
FIG. 3 is cross-sectional detail view, drawn along line 3-3 in FIG. 2.

Referring also to FIG. 3, each slot 260, preferably, is formed by plunge cutting with a rotary saw blade (not shown). Slot 260 is defined by annular surfaces 263, each having curvatures corresponding to the radius of the plunge-cutting saw blade. Annular surfaces 263 and side surface 205 (comparable to side surface 105 of form 100) define opposed proximal intersections 265. Annular surfaces 263 and back surface 215 (comparable to back surface 115 of form 100) define opposed distal intersections 270.

Figure 4:
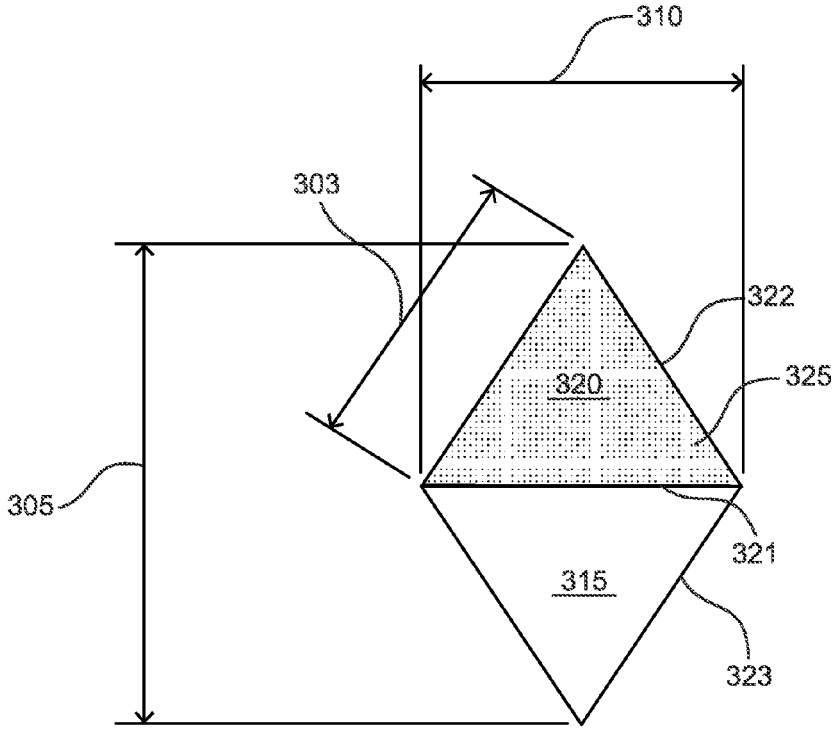
FIG. 4 is a plan view of a plate of the embodiment of FIG. 2.

Referring also to FIG. 4, each plate 300, preferably, is constructed of steel or any material, metallic or non-metallic, that is suitable for a load transfer device between adjacent concrete slabs in a pavement. To economize production costs, plate 300 may be shear-cut. Plate 300 is 0.250-0.375 inches thick and has a side dimensions 303 of approximately 4.5 inches, or other dimension suitable for purposes described herein. Preferably, plate 300 has a length 305 that is greater than or equal to a width 310. Thus, plate 300, in plan view, assumes the shape of a rhombus or square.

Plate 300 has a first portion 315 and a second portion 320, delineated by a plane 321 defined by the intersections of sides 322 and 323 that are aligned with side surface 205. First portion 315 may be untreated. Second portion 320 has an elastomer coating 325 configured to adhere to concrete, but not to plate 300. Elastomer coating 325 is constructed of polymers, grease or other materials suitable for the purposes described herein.

In practice, when a first concrete slab adheres to elastomer coating 325 on second portion 320 and a second concrete slab adheres to first portion 315, lateral movement among the slabs, due to shrinkage, etc., will not cause localized stresses because the first and second slabs are not fixed to plate 300, rather, one slab is permitted to move relative to plate 300 because it is adhered to elastomer coating 325. While elastomer coating 325 originally adheres to plate 300 when plate 300 is manufactured, curing concrete exerts forces on elastomer coating 325 which urges elastomer coating 325 to slide relative to plate 300 once installed.

Alternative embodiments of the invention include coatings that: (1) adhere to plate 300, but not to concrete, thereby allowing concrete to slide relative to the coating; or (2) do not adhere to plate 300 or concrete, thereby allowing concrete to slide relative to plate 300 and/or the coating.

Referring again to FIG. 2, first portion 315 is received in slot 260. Preferably, slot 260 has a tolerance of 0.03125 inch among horizontal surfaces of slot 260 and first portion 315. This close tolerancing promotes closely receiving first portion 315 in slot 260. This provides for maintaining plate 300 at a desired attitude. Elastomer coating 325 is likely to have a thickness exceeding this tolerance that would prevent slot 260 from receiving second portion 320.

Referring also to FIG. 3, plate 300 is configured such that intersections of sides 322 and 323 at the widest extremes of plate 300 mate with proximal intersections 265 of form 200. This configuration promotes a gap-free junction between plate 300 and form 200 that discourages concrete from seeping therethrough. This ensures that concrete only contacts elastomer coating 325 and not plate 300.

Plate 300 also is configured, and the radius of a saw (not shown) used for plunge cutting slot 260 is selected, such that distal intersections 270 in form 200 firmly cradle first portion 315. This configuration prevents plate 300 from undesired rotation or movement relative to form 200 despite significant forces exerted on plate 300 by concrete when poured on form 200 and plate 300.

Figure 7:
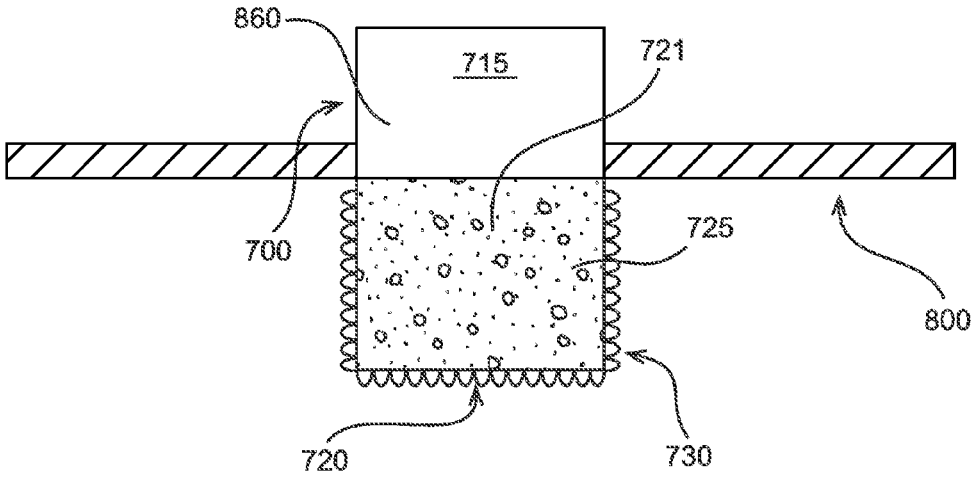
FIG. 7 is a plan view of another embodiment of an apparatus for forming concrete configured according to principles of the invention, shown partially in cross-section.

Referring to FIG. 7, another embodiment of a plate 700 configured according to principles of the invention has a first portion 715 and a second portion 720, delineated by a plane 721. First portion 715 may be untreated. Second portion 720 has an elastomer coating 725 that is similar to elastomer coating 325.

In practice, first portion 715 is received in a slot 860 in a form 800 in a direction aligned with a side 730 extending along first portion 715 and second portion 720. Coating 725, having a preferred thickness of about 0.03 inches and being compressible, allows a cured slab (not shown) adhered thereto to move somewhat relative to second portion 720.

Figure 8:
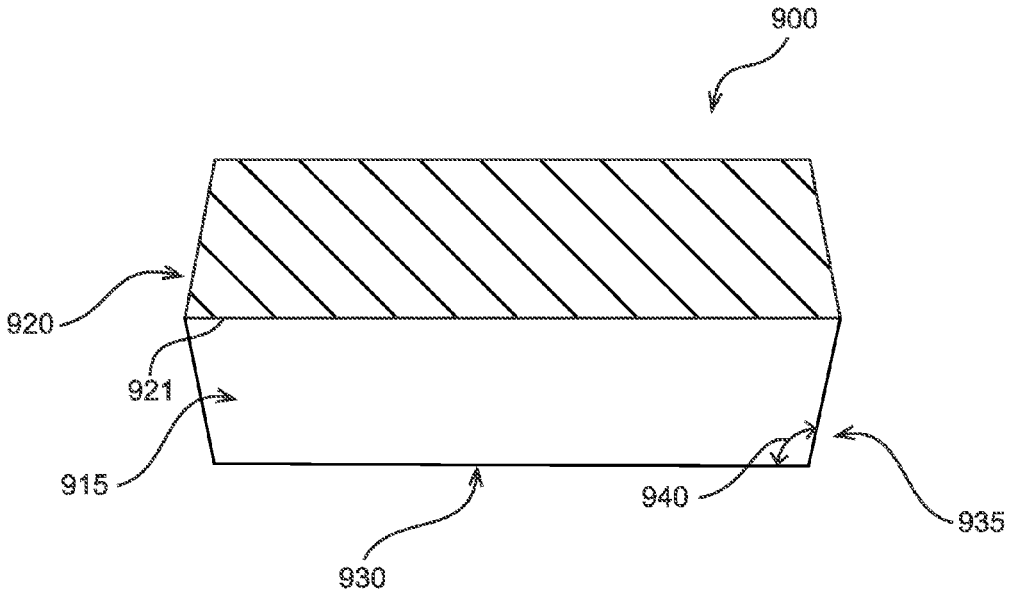
FIG. 8 is a plan view of a further embodiment of an apparatus for forming concrete configured according to principles of the invention.

Referring to FIG. 8, another embodiment of a plate 900 configured according to principles of the invention has a hexagonal shape. Plate 900 has elongated bases 930, each with adjacent sides 935. Preferably, each base 930 and side 935 define an angle 940 of about 100°. Angle 940 may exceed 100° in any amount that maximizes the material and/or stress dissipation nearest the joint between concrete slabs.

As with the embodiments described above, plate 900 has a first portion 915 and a second portion 920, delineated by a plane 921. First portion 915 may be untreated. Second portion 920 has an elastomer coating 925 that is similar to elastomer coating 325.

In practice, when a first concrete slab adheres to elastomer coating 925 on second portion 920 and a second concrete slab adheres to first portion 915, lateral movement among the slabs will not cause localized stresses because the first and second slabs are not fixed to plate 900, rather, one slab is permitted to move relative to plate 900 because it is adhered to elastomer coating 925.

Figure 9:
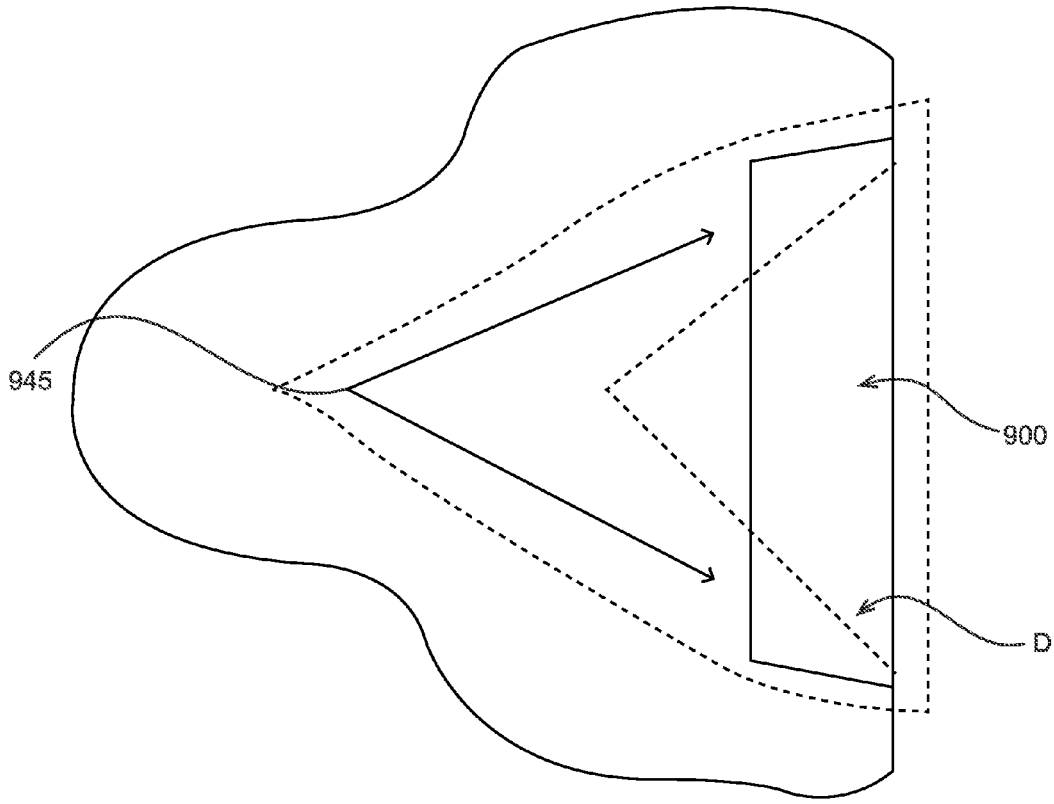
FIG. 9 is a schematic view of a portion of the embodiment of FIG. 8 received in a vertical joint face of a concrete slab, a dashed-line outline of a diamond-shaped plate being superimposed thereon.

Referring also to FIG. 9, plate 900 is shown received in the vertical face of a concrete slab. The hexagonal geometry of plate 900, as compared with a diamond-shaped plate D, as shown in dashed lines in FIG. 9, provides more support material 945 at a joint between concrete slabs. This is due to the preferred 100° angle between base 930 and side 935, which provides nearly 18% additional support material over that provided by a diamond-shaped plate D.

Hexagonally-shaped plate 900 allows for faster and more efficient stress dissipation at the joint. This is because a hexagonal plate presents more perimeter in areas of high stress concentration in a cement slab. This allows for reducing the material thickness needed in a load plate, which saves material costs and machine wear. For example, a plate 900 interposed between four-inch slabs having a compressive strength of 3000 pounds-per-square-inch need only have a 3/16-inch thickness, whereas a diamond-shaped plate must have at least a ¼-inch thickness. Reduced plate thickness also promotes plate yield before concrete failure. An advantage of this is that, under great loading, plate 900 yields, rather than causing failure in the adjacent concrete slabs plate 900 ties together. Thus, the vertical relationship of slabs still is contained, without catastrophic concrete failures that would require slab replacement.

Another advantage of hexagonally-shaped plate 900 relative to a diamond-shaped plate is that concrete tends to consolidate better under plate 900 because plate 900 presents less area under which concrete flows. This reduces the potential for pockets and voids forming under plate 900, which could lead to joint failure or ineffective load transfer.

A further advantage of plate 900 is that plate 900 presents surfaces that are more stable, or less likely to move, during pouring of concrete. This assures that the load plate will assume proper placement and orientation relative to the joint, thus is more likely to perform as intended.

Figure 10:
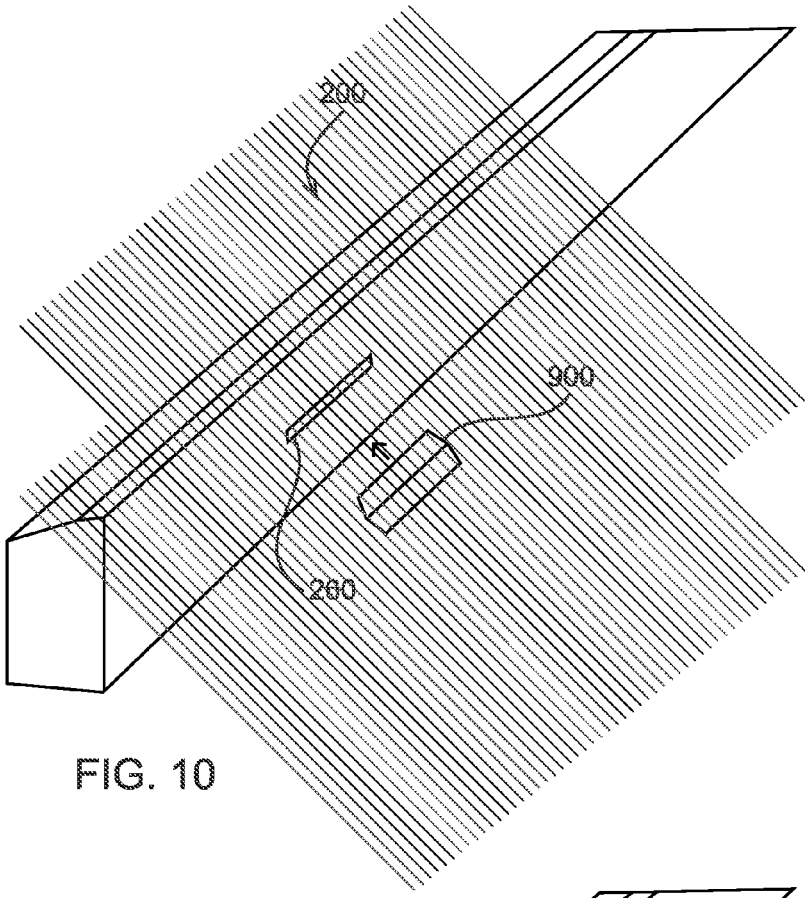
FIGS. 10 and 11 are perspective views of the embodiment of FIG. 1 receiving the embodiment of FIG. 8.
Figure 11:
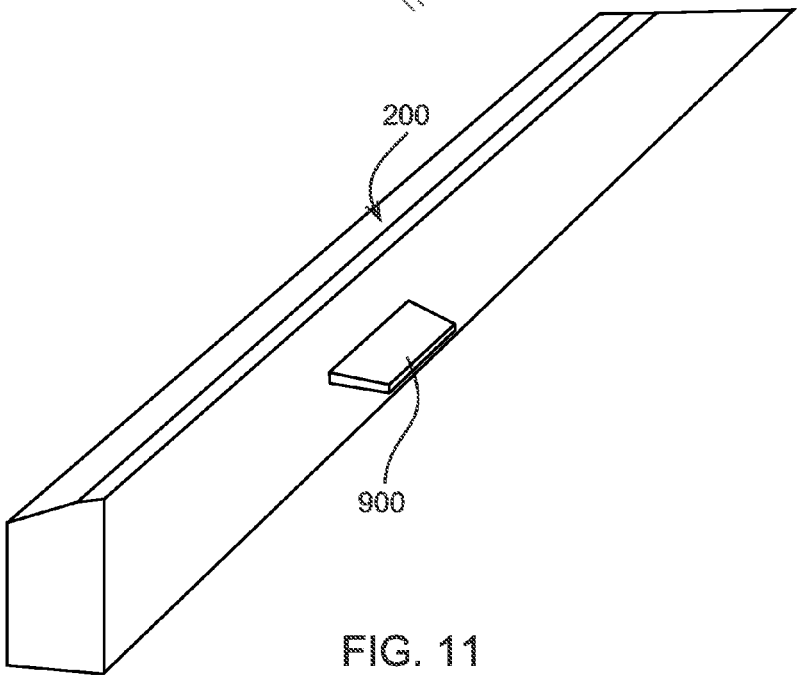

Referring to FIGS. 10 and 11, as with plate 300, plate 900 is intended to be received in slot 260 in form 200.

Figure 12:
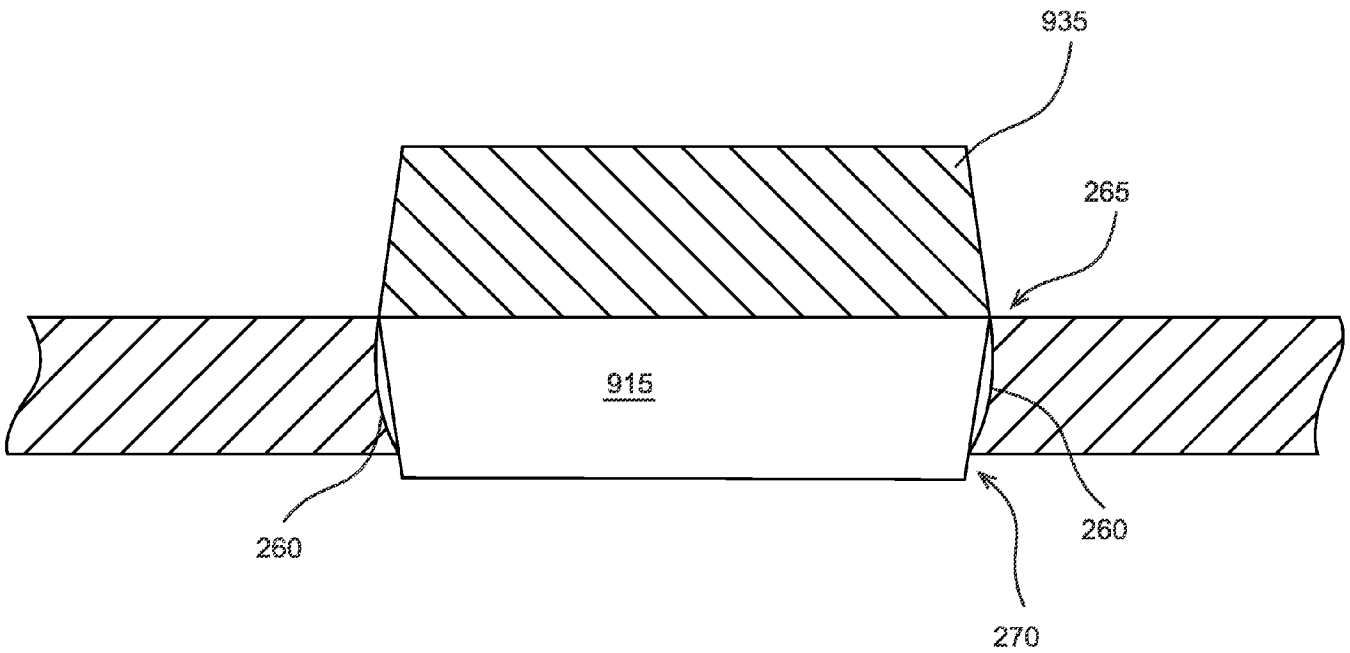
FIG. 12 is a top view of the embodiment of FIG. 1 receiving the embodiment of FIG. 8, shown partially in cross section.
Figure 13:
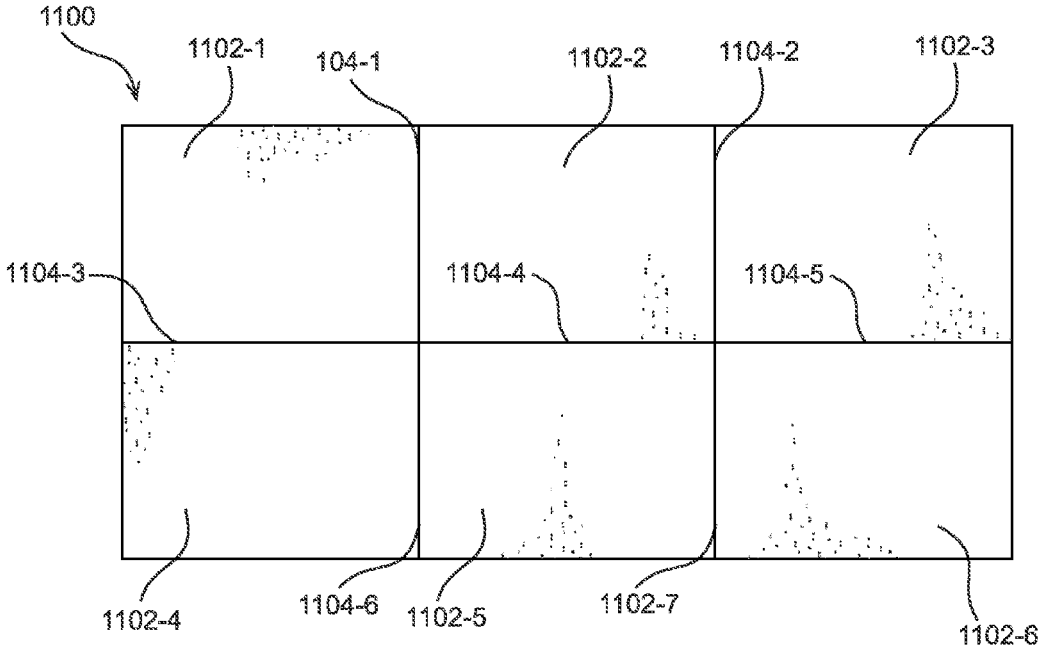
FIG. 13 is a plan view of a plurality of concrete slabs defining a pavement.
Figure 14:
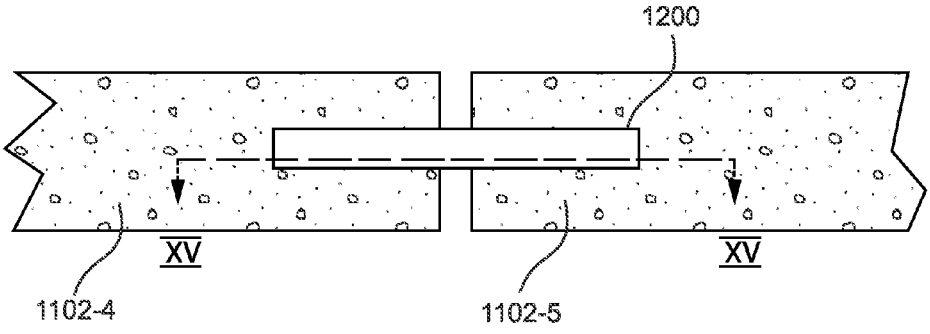
FIG. 14 is a vertical cross-sectional detail view of adjacent concrete slabs and an interposed prior art dowel.
Figure 15:
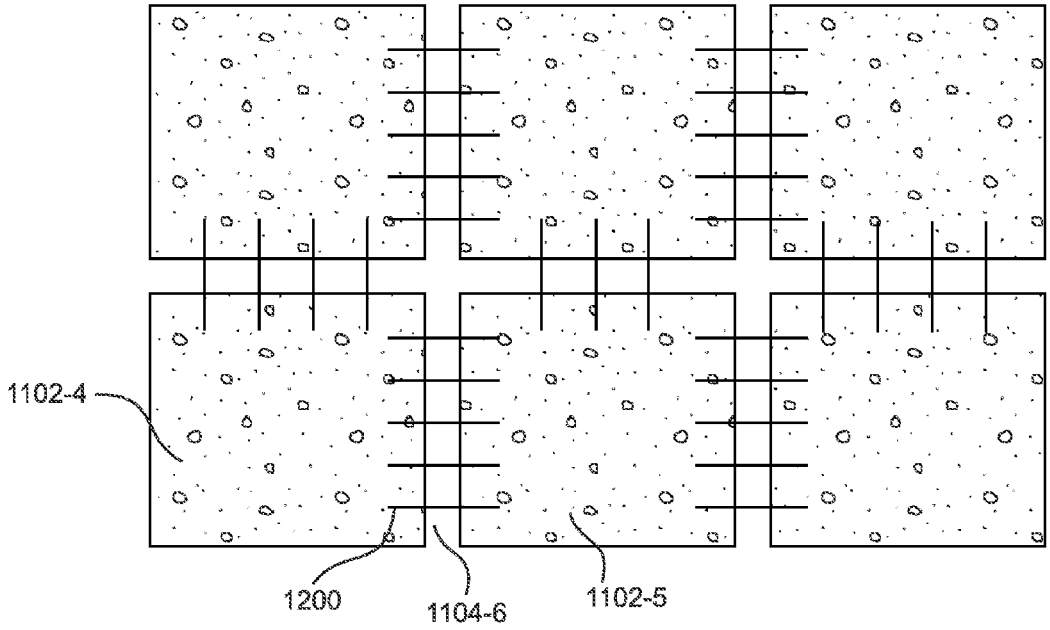
FIG. 15 is cross-sectional detail view drawn along line XV-XV in FIG. 14.
Figure 16:
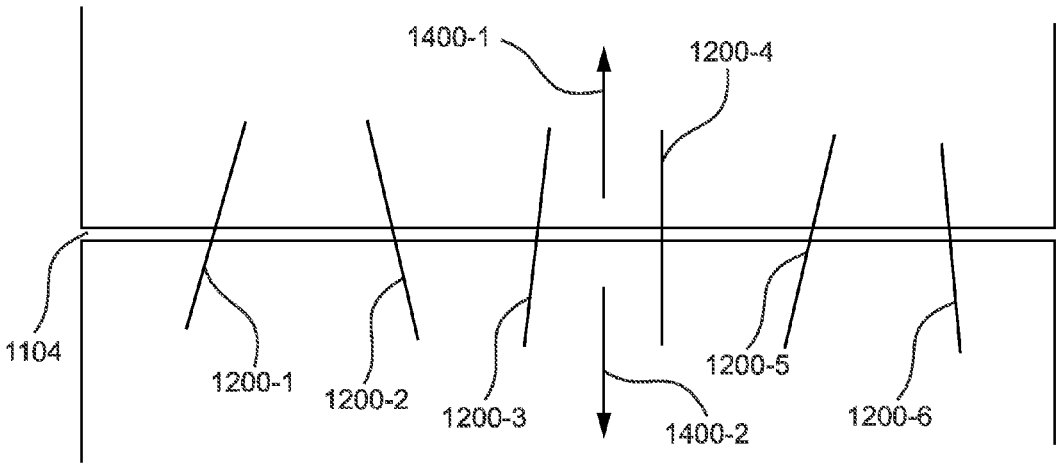
FIG. 16 is an enlarged horizontal cross-sectional detail view of a plurality of concrete slabs with interposed prior art dowels that are misaligned.
Figure 17:
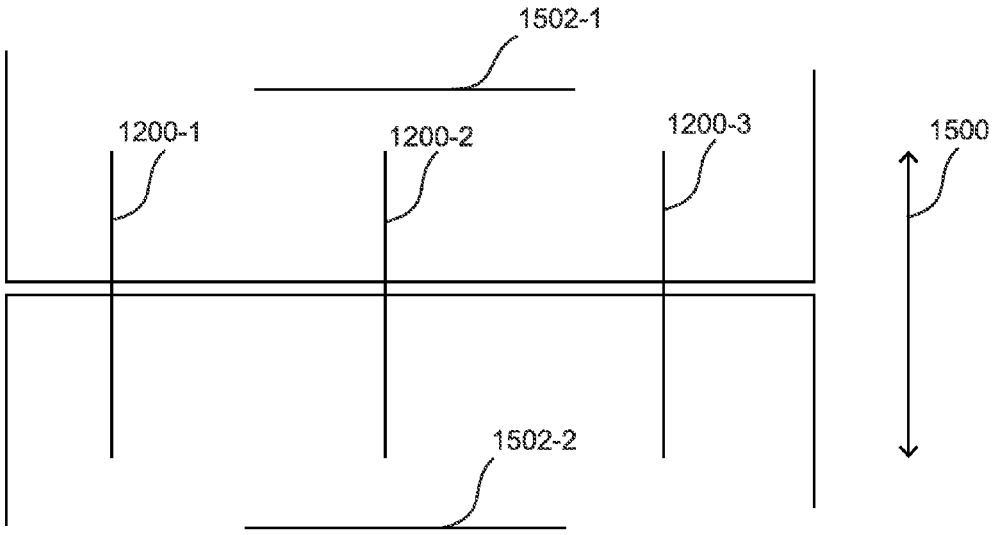
FIG. 17 is an enlarged horizontal cross-sectional detail view of a plurality of concrete slabs with interposed prior art dowels.
Figure 18:
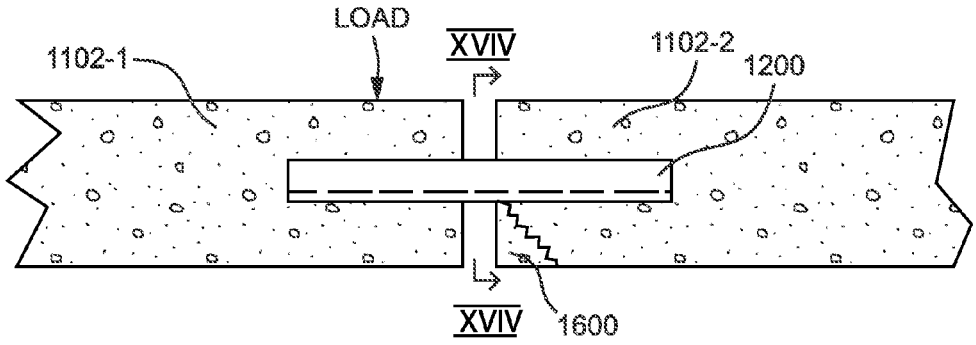
FIG. 18 is a vertical cross-sectional detail view of adjacent concrete slabs and an interposed prior art dowel wherein one slab exhibits a failure.
Figure 19:
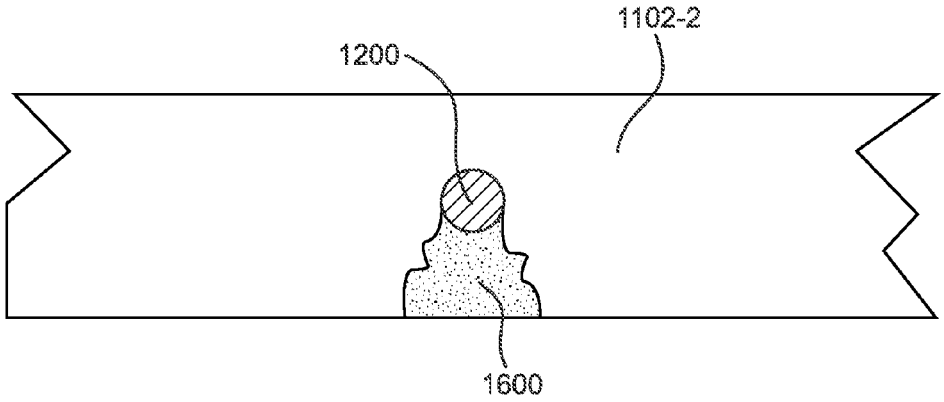
FIG. 19 is a cross-sectional detail view drawn along line XVIV-XVIV in FIG. 18.

Referring to FIG. 12, plate 900 is configured such that intersections of sides 935 define a widest extreme of plate 900 that mate with proximal intersections 265 of form 200. This configuration promotes a gap-free junction between plate 900 and form 200 that discourages concrete from seeping therethrough. This ensures that concrete only contacts elastomer coating 925 and not plate 900.

Plate 900 also is configured, and the radius of a saw (not shown) used for plunge cutting slot 260 is selected, such that distal intersections 270 in form 200 firmly cradle first portion 915. This configuration prevents plate 900 from undesired rotation or movement relative to form 200 despite significant forces exerted on plate 900 by concrete when poured on form 200 and plate 900. The hexagonal shape of plate 900 renders plate 900 more stable in, and less prone to moving relative to form 200 than diamond-shaped plates during pouring.

Figure 5:
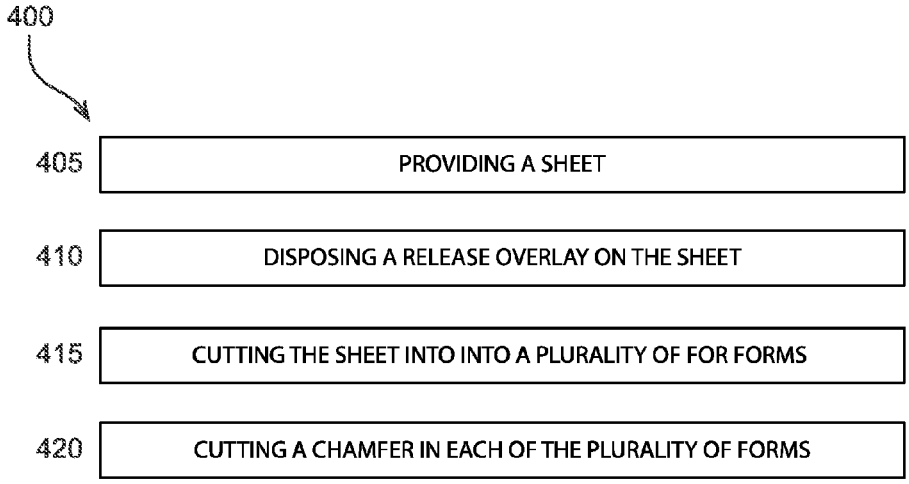
FIG. 5 is a schematic view of an embodiment of a method of making an apparatus for forming concrete configured according to principles of the invention.

Referring to FIG. 5, an embodiment of a method 400 configured according to principles of the invention includes: a step 405 of providing a sheet; a step 410 of disposing a release overlay on the sheet; a step 415 of cutting the sheet into a plurality of forms; and a step 420 of cutting a chamfer in each of the plurality of forms.

Step 405 of providing a sheet of material includes material suitable for performing as a concrete form, preferably OSB stock material. However, the material may be dimensioned lumber, particle board, steel and other suitable materials if commensurate with the purposes described herein. OSB material is preferred because it can assume virtually any width, length or thickness that may be machined into forms of appropriate, true dimensions for defining the desired pavement. The length of the material, ideally, should be as long as the longest side of the pavement desired. However, manufacturing material that is, e.g. two miles long, is problematic for contemporary manufacturers.

Step 410 of disposing a release overlay on the sheet includes an overlay that is suitable for retaining poured concrete without adhering thereto or marring the finished surface thereof when the concrete cures and is separated from the form.

Step 415 of cutting the sheet into a plurality of forms ties into step 405 in that the material to be cut should be selected to maximize the number of forms machined and minimize any scrap not suitable to be a form. The number of forms derived from the sheet depends on the thickness of pavement desired, which dictates the height of the forms needed. Ideally, the width of the sheet of material provided in step 405 should be an even multiple of the form height, plus some allowance for cutting.

Step 420 of cutting a chamfer in each of the plurality of forms involves machining each form derived from step 415 with a chamfer machine that cuts chamfers in board stock. The chamfer may assume any angle suitable for purposes described herein, but preferably ranges from 220 to 45°. Step 420 provides tremendous labor savings over prior art techniques and materials. Ordinarily, concrete workers field cut chamfers into concrete forms on site, which consumes considerable time. Providing workers with pre-chamfered forms eliminates this on-site step and allows for faster completion of the paving job at hand.

Figure 6:
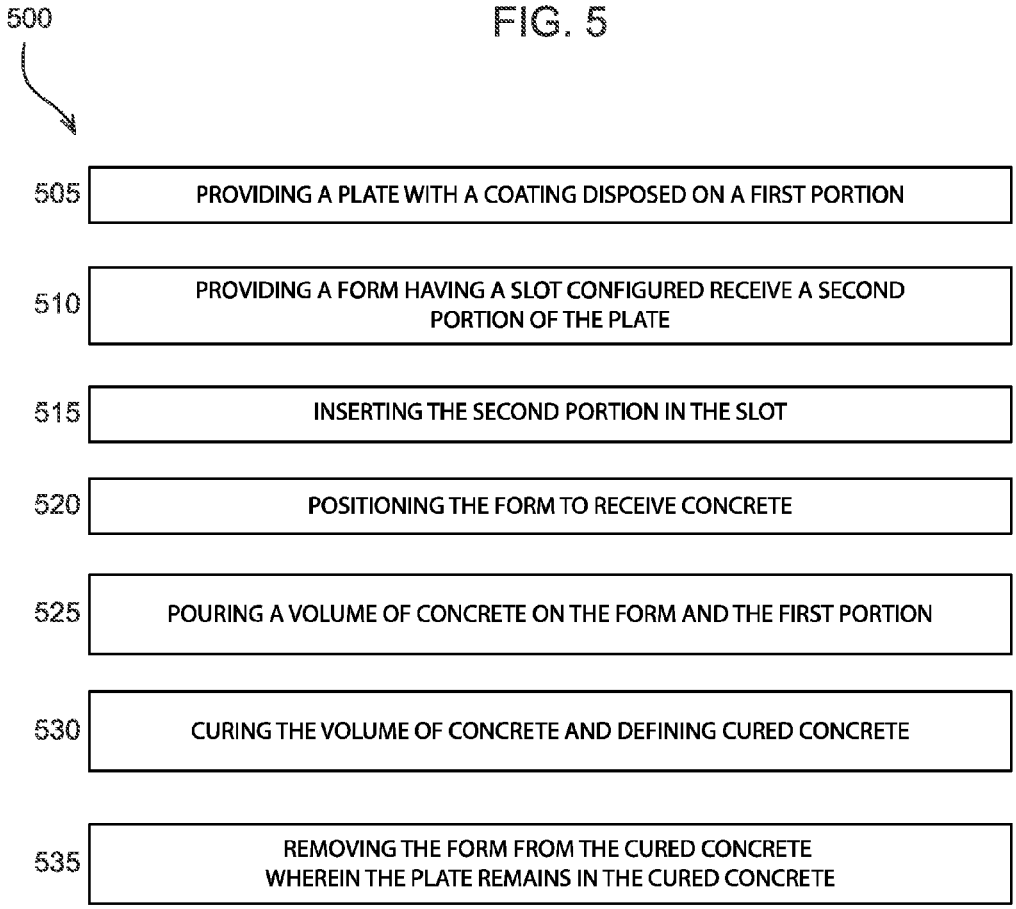
FIG. 6 is a schematic view of an embodiment of a method of forming concrete configured according to principles of the invention.

Referring to FIG. 6, an embodiment of another method 500 configured according to principles of the invention includes: a step 505 of providing a plate with a plate coating disposed on a first portion thereof; a step 510 of providing a form having a slot configured receive a second portion of the plate; a step 515 of inserting the second portion in the slot; a step 520 of positioning the form to receive concrete; a step 525 of pouring a volume of concrete against the form and the first portion; a step 530 of curing the volume of concrete and defining cured concrete; and a step 535 of removing the form from the cured concrete, wherein the plate remains in the cured concrete.

Step 505 of providing a plate with a plate coating disposed on a first portion thereof involves preparing a plate 300 as described above. An elastomer coating, configured to adhere to concrete, but not to the plate, is disposed on the first portion of a plate.

Step 510 of providing a form having a slot configured receive a second portion of the plate involves plunge cutting the side surface of a form with a rotary blade having a predetermined radius selected according to the configuration of the plate received in the slot, as described above.

Step 515 of inserting the second portion in the slot represents a significant cost savings over prior load plate installation apparatuses and methods. Rather than attaching to a form a mounting plate and blockout sheath, then, after the slab has cured, removing the form while breaking free the blockout sheath followed by inserting a load plate in the blockout sheath, the present method embeds a load plate directly into the concrete slab as it cures. Once the concrete cures, the forms are removed with the load plate already embedded in the concrete and no further installation required.

Step 520 of positioning the form for receiving concrete also represents an advance over many typical concrete pouring techniques in use. Because the forms are precisely cut prior to being staked around the desired pavement area, they present a true height from support surface to pavement surface. This deters concrete from leaking through any gap that often exists between the support surface and the bottom surface of inadequately sized prior art forms.

Step 525 of pouring a volume of concrete against the form and the first portion and step 530 of curing the volume of concrete and defining cured concrete are conventional, thus described no further.

Step 535 of removing the form from the cured concrete wherein the plate remains in the cured concrete, as described above, represents a significant departure from current practices. Once the concrete cures, the forms are removed with the load plate already embedded in the concrete. Other methods require detaching a form from a mounting plate previously attached thereto, then installing a load plate in the pocket formed in the concrete.

The invention is not limited to the particular embodiments described and depicted herein, rather only to the following claims.

I claim:

1. Apparatus for transferring a load between a first concrete slab and a second concrete slab, defining a joint, comprising:

a plate defining a hexagon having a base parallel with the joint, said plate having a first portion and a second portion; and an elastomer coating disposed on said first portion;

wherein:

said base and a side define an angle greater than or equal to 100°; and/or said plate is configured to maximize material proximate to the joint; and said elastomer coating slides relative to said plate, the first concrete slab or combinations thereof.

2. Apparatus of claim 1, wherein said plate has a thickness such that said plate yields at an amount that would be likely to cause failure in either of the first concrete slab or the second concrete slab.

3. Apparatus of claim 1, wherein said elastomer coating has a thickness of about 0.03 inches.

* * * * *